United States Patent [19]

Joutras

[11] Patent Number: 4,778,173

[45] Date of Patent: Oct. 18, 1988

[54] APPARATUS FOR JUMPING ROPE

[75] Inventor: Frank E. Joutras, Lincoln, Nebr.

[73] Assignee: Flexion Fitness Products, Lincoln, Nebr.

[21] Appl. No.: 55,631

[22] Filed: May 29, 1987

[51] Int. Cl.[4] ..... A63B 5/20

[52] U.S. Cl. ..... 272/75; 272/122

[58] Field of Search ..... 272/74, 75, 122; 24/135 N

[56] References Cited

U.S. PATENT DOCUMENTS

| | | | |
|---|---|---|---|
| 141,706 | 8/1873 | Downing | 24/135 N |
| 254,473 | 3/1882 | Gates | 24/135 N |
| 1,584,122 | 5/1926 | Moore | 272/75 |
| 4,157,827 | 6/1977 | Winston et al. | 272/75 |
| 4,637,606 | 1/1987 | Hunn | 272/75 |
| 4,647,037 | 3/1987 | Donohue | 272/75 |

FOREIGN PATENT DOCUMENTS

| | | | |
|---|---|---|---|
| 134345 | 9/1949 | Australia | 272/75 |

*Primary Examiner*—Richard J. Apley
*Assistant Examiner*—J. Welsh
*Attorney, Agent, or Firm*—Vincent L. Carney

[57] ABSTRACT

To reduce bearing wear and rope delay when jumping rope, a weight-adjustable jumping rope handle includes a hollow handle body having a longitudinal axis and a hand grip formed on the outer surface of the body circumscribing the longitudinal axis. A pivotable rope holder is mounted to pivot with respect to the handle about the longitudinal axis and includes a pivotable adjustable clamp for holding the end of the rope in a direction perpendicular to the handle body. A different selected weight is inserted into two hollow handle bodies with the weights being equal.

1 Claim, 3 Drawing Sheets

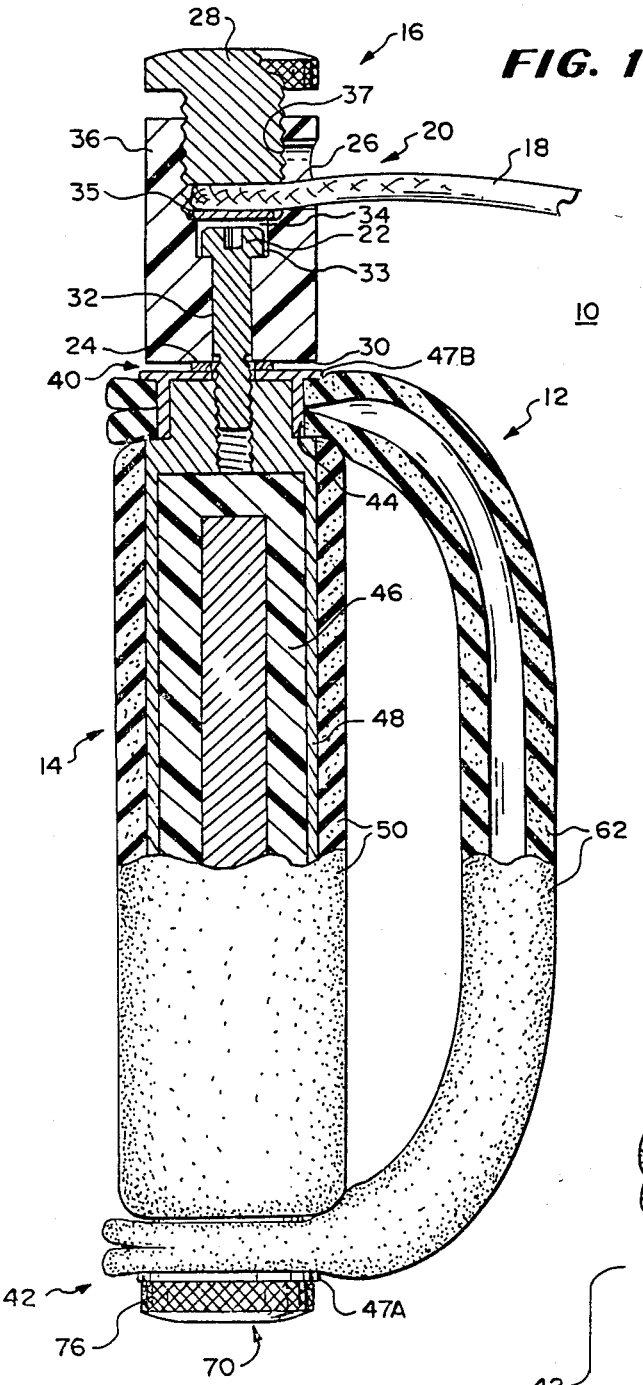
FIG. 1
FIG. 2
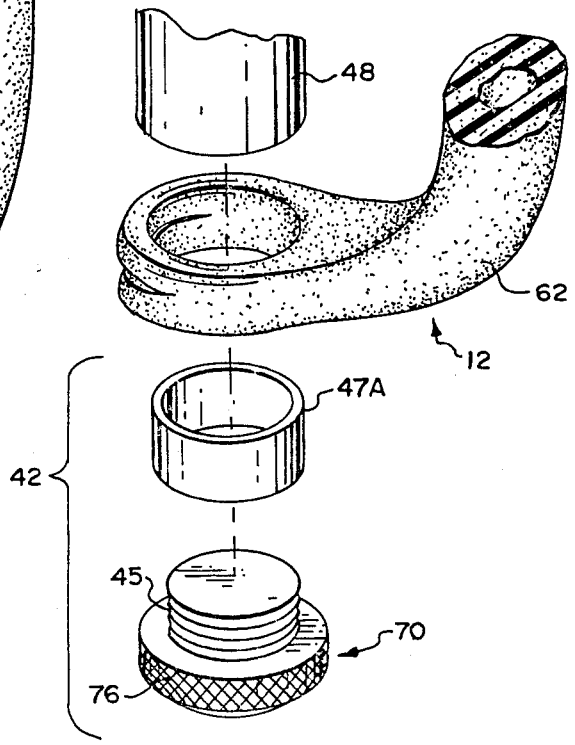

APPARATUS FOR JUMPING ROPE

BACKGROUND OF THE INVENTION

This invention relates to appliances which aid persons in exercising and to methods of using such appliances.

One class of appliance and method for exercising includes a holder for a rope to be used in the exercise of jumping rope, with the holder having a pivotable portion that permits the rope to pivot freely in the appliance. It has also been suggested that weights be used in jumping rope to provide upper body muscle development.

In the prior art appliances and methods for jumping rope, the appliance for pivotably holding the rope includes a ball bearing racer held in place by a staple on the rope, with the rope being pivotably held by the ball bearing racer to extend from the handle. The end of the rope is mounted to extend from, be aligned with and pivot about a common axis extending through the longitudinal axis of the handle. With this arrangement, the end of the rope is bent at an angle to the pivot axis a short distance from the pivot point. In many such prior art holders the pivot means is separate from the weights.

The prior art exercise appliances have several disadvantages such as for example: (1) not pivoting freely and being subject to locking because of the manner the rope is held by them; (2) being inconvenient to use; (3) being difficult to adjust for the desired amount of weight or to remove the rope; and (4) causing delay in the turning of the rope because it is bent at a sharp angle a short distance from the handle.

Another class of exerciser includes two handles that are pulled apart or pushed together against a biasing pressure and then permitted to return to their original position. In some of these exercisers, the two handles are intended to be used with one hand in others two hands are used.

In prior art exercisers of this type, the force which is worked against is provided by a spring. These prior art appliances have several disadvantages such as: (1) the force required to move them is not uniform but depends on the distance the two handles have moved; and (2) they are relatively difficult to adjust to provide different forces.

SUMMARY OF THE INVENTION

Accordingly, it is an object of the invention to provide a novel appliance for exercising and a novel method for exercising.

It is a further object of this invention to provide appliances for exercising in which the amount of force necessary to use the appliance may be easily adjusted.

It is a still further object of the invention to provide a novel appliance and method for jumping rope in which the rope may be easily attached and removed.

It is a still further object of the invention to provide a novel appliance for jumping rope in which the rope ends extend from and pivots about at an angle axis ninety degrees to the rope.

It is a still further object of the invention to provide a novel hand or arm exerciser in which the force necessary to move the parts of the appliance by one hand or by both of the hands and the arms may be readily adjusted and is substantially uniform.

In accordance with the above and further objects of the invention, an exerciser for jumping rope includes a body portion, a grip and a pivotable rope holding portion. The body portion includes means for adjustably controlling the total weight of the exerciser, whereby the exerciser may be used to jump rope while having an easily adjustable selectable weight on it. The pivotable rope holding portion mounts the end of the rope perpendicularly to the axis of rotation and allows the rope to be removed or switched easily.

Advantageously, the body portion of the exerciser for jumping rope is hollow and the grip is formed over and is part of the hollow body portion, with the pivotable rope holder pivoting on the body portion. The weight or weights may be inserted in the body portion and are of different weight to control the weight in the exerciser.

In use, a person opens each of the body portions and inserts within them weights selected to provide the desired weight before closing it. The rope is then attached with one of the rope being attached to one exerciser and the other end of the rope being attached to another exerciser. After this is done, a person may jump rope, with the inertial force of the rope causing the pivotable sections to turn with the rope. The exerciser may also be used without the rope in other exercises.

Another embodiment of exerciser includes first and second handles mounted for movement with respect to each other, a biasing means for biasing them in one direction and friction means connecting the two handles, with the friction means being adjustable to adjust frictionally the amount of pressure necessary to move the two handles together.

In the preferred embodiment, the two handles are positioned close together to be held by one hand and the exercise is performed by closing and opening the hand to move the handles against the frictional force. The biasing means aids in opening the handles but otherwise does not play a substantial role in controlling the force.

It can be understood from the above description that the exercising appliance of this invention, when used in the method of this invention, has several advantages such as: (1) it is simple in construction and economical; (2) it is easy to adjust to provide different forces against which the exerciser works; (3) it forms a compact single unit without the need for weights to be held separately from the handles or the like; (4) the rope pivots about an axis to which it is perpendicular, thus eliminating rope end bending and reducing rope lag; and (5) the rope may be removed easily to use handles as aerobic hand weights.

SUMMARY OF THE DRAWINGS

The above noted and other features of the invention will be better understood from the following detailed description when considered with reference to the accompanying drawings, in which:

FIG. 1 is an elevational view, partly sectioned, of an exerciser for jumping rope in accordance with the invention;

FIG. 2 is a fragmentary exploded view of a portion of the exerciser of FIG. 1;

DETAILED DESCRIPTION

Figure 3:
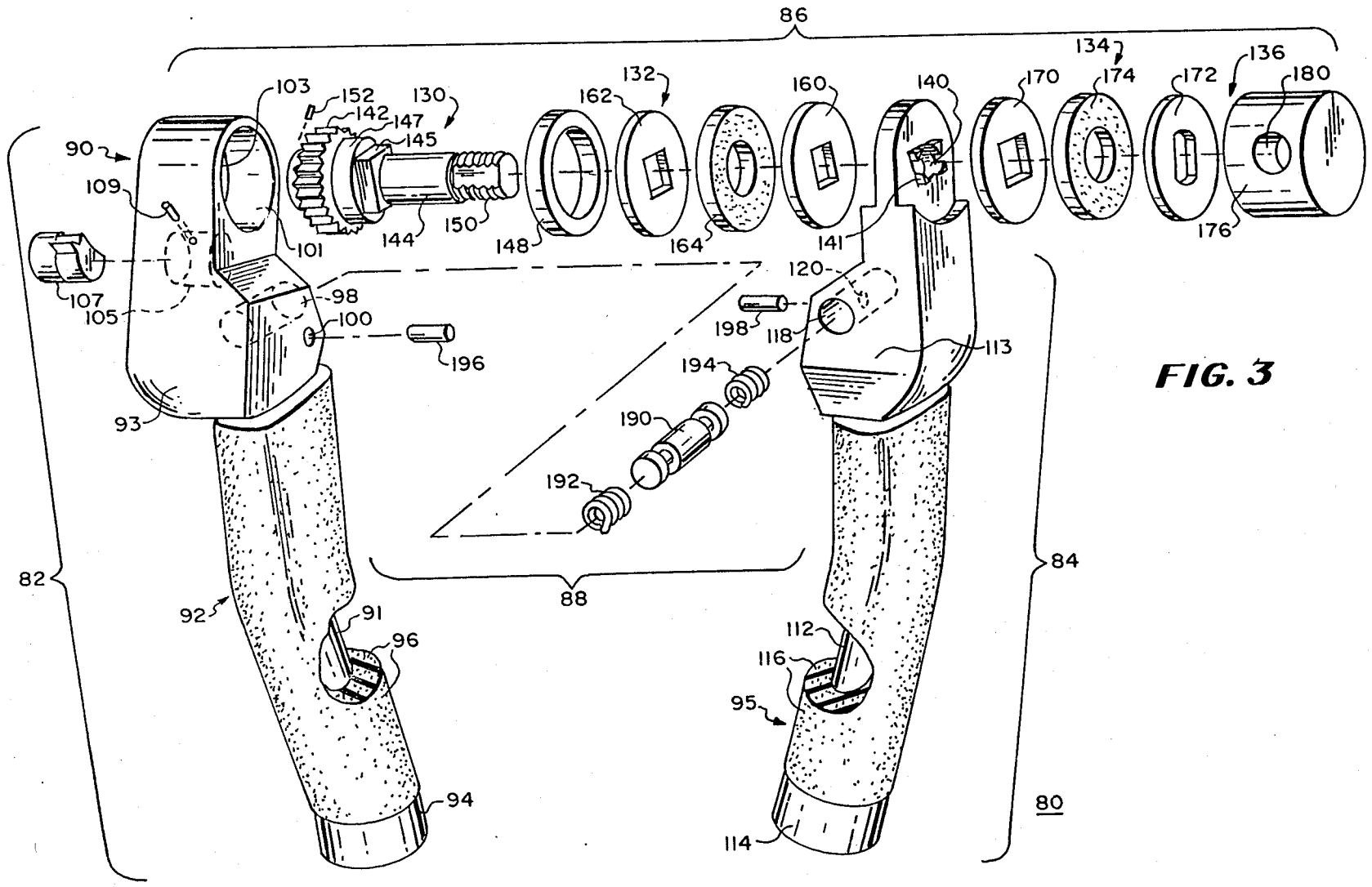
FIG. 3 is an exploded perspective view of a hand grip exerciser.

In FIG. 1, there is shown a partly-sectioned elevational view of a weighted jumping rope holder 10 connected to a jumping rope 18 and usable as an exerciser. The weighted jumping rope holder 10 includes a flexible strap 12, a weight-adjustable body 14, and a pivotable rope mounting section 16 adapted to engage one end of a jumping rope 18. The pivotable rope mounting section 16, in the preferred embodiment, is mounted to pivot with respect to both the flexible strap 12 and the weight-adjustable body 14. The weight-adjustable body 14 serves as a handle or grip and cooperates with the flexible strap 12 for convenient holding of the exerciser by the user.

The pivotable rope mounting section 16 includes a pivot member 20, a pivot pin 22, a rope sleeve 26, and a pressure adjustment means 28. In some embodiments a self-lubricating washer 24 is included and in others it is omitted but a portion of the pivot member 20 is self-lubricating. The pivot member 20 is pivotably mounted to the weight-adjustable body 14 by the pin 22, which connects the two and thus permits rotation of the pivot member 20 with respect to the weight-adjustable body 14 and the flexible strap 12.

The rope sleeve 26 extends through the pivot member 20 in a direction orthogonal to the longitudinal axis of the weight-adjustable body 14 and includes at its top an internally-threaded cylinder adapted to receive an externally-threaded thumb screw 28 which serves as a pressure adjustment means to hold the rope 18 within the rope sleeve 26 by pressing against its upper surface to pinch it between the pivot member 20 and the pressure adjustment means 28.

The pivot member 20 may be of nylon or similar self-lubricating material or may be of steel and rest against a portion of the weight-adjustable body 14 which is a suitable bearing material or against a washer 24 or other bearing surface to permit ready pivoting. It thus includes: (1) a surface complimentary formed to the end surface of the weight-adjustable body 14 to provide such pivoting; (2) a hole 32 through its center; and (3) a counterbore 33 adapted to receive the pivot pin 22 to hold it in place with the bearing surface 30 of the pivot member 20 mounted to rotate with respect to the weight-adjustable body 14.

In the preferred embodiment, the bearing surface 30 is self lubricating and rests upon a backing for the flexible strap 12 and the weight-adjustable body 14 in a manner to be described hereinafter. The pivot pin 22 is a threaded self-locking shoulder bolt which threads into an integrally-formed end portion 40 of the weight-adjustable body 14 and fits within the counterbore 33 with its head resting upon a shoulder between the counterbore 33 and the hole 32 to permit pivoting of the pivot member 20 while holding it with respect to the weight-adjustable body 14.

The counterbore 33 includes a centrally-located annular shoulder 34 surrounded by a cylindrical outer rim 36 which receives the rope sleeve 26 to hold the jumping rope 18 and includes threads on its inner surface at 37 into which the pressure member 28 may be threaded. The rope sleeve 26 is a hole extending perpendicularly to the side wall of the pivot member 20 and to its axis of rotation to receive the rope 18. A disc-shaped spacer 35 rests on the shoulder 34 to support the rope 18 against the pressure of the thumb screw pressure means 28.

To enable the weight of the jumping rope holder 10 to be adjusted, the weight-adjustable body 14 includes an integrally-formed end portion 40, an inner end member 42, at least one cylindrical weight indicated generally at 46, an an outer cylindrical wall 48 covered by a foam rubber covering 50 to form a tubular cylindrical body portion. The tubular cylindrical body portion is: (1) adapted to receive one 46 a plurality of cylindrical weight within it; (2) enclosable at the inner end by the inner end member 42; and (3) closed at its outer end by the integrally-formed end portion 40, which includes the neck 44 forming an annular shoulder to receive the flexible strap 12 in a manner to be described hereinafter.

The cylindrical weights 46 may be of different proportions of metal and plastic or a plurality of weights may be used to enable the total weight to be adjustable and, for that purpose, may conveniently be made of lead, steel and/or plastic such as low density polyethylene. In the preferred embodiment, they are plastic coated lead and the proportion of lead and plastic controls how heavy they are. They are generally cylindrical shaped with an outer diameter the same size as the inner diameter of the tubular body portion. The outer cylindrical wall 48 is conveniently of metal or plastic and contains foam rubber in a thin layer over it for comfort.

To aid the user to hold the grip of the jumping rope holder 10, the flexible strap 12 is in a U-shape with the two legs of the "U" engaging the weight-adjustable body 14 at spaced-apart locations. The legs and bottom of the "U" are formd of a foam rubber cylinder 62 with washers 47A and 47B inserted in aperatures near the ends of the legs of the "U" to hold the flexible strap in place. The central apertures of the washers fit about the threaded neck 45 (FIG. 2) of the end 70 and the neck 44 of the integrally-formed end portion 40. The flexible strap 12 aids in holding the exercisers on the hands against the pressure exerted against the hands by the weight of the exerciser. There is enough space between the leg of the "U" and the outer surface of the of the weight-adjustable body 14 to accommodate the fingers of the user. This distance is at least ¼ inch.

To fasten the flexible strap 12, the apertures in the washers serve as reinforcing for eyelets in the flexible strap and is held about the neck of the end pieces between the outer cylindrical wall 48 and the integrally-formed end portion 40 by the tightening of the end piece 70 to pull the integrally-formed end portion 40 against the outer cylindrical wall 48. The eyelets are mounted between a washer 47A and the inner end member 42 by the tightening of the end piece on the end threaded portion of the neck 44.

In FIG. 2, there is shown an exploded perspective fragmentary view of a portion of the flexible strap 12 and the inner end member 42 illustrating the manner in which they are connected together. As shown in this view, the inner end member 42 includes a foam rubber cylinder 62 of the flexible strap 12 and is of substantially the same outer diameter as the washer 47A and the finger bolt 70 which together comprise the inner end member 42. The underside of the finger bolt 70 includes a threaded neck 45 and a knurled cylindrical band 76.

In FIG. 3, there is shown an exploded perspective view of a hand exerciser 80 having a first handle assembly 82, a second handle assembly 84, a pressure control section 86, and a spring biasing assembly 88. In the hand exerciser 80, the first and second handle assemblies 82 and 84 are manually pressed together against a fixed frictional resistance in the pressure control section 86 until a certain distance has been moved and then they are released and moved apart by a relatively weak spring in the biasing assembly 88.

The same principle may be used with exercisers in which handles are pulled apart until a certain movement has occurred and then the friction released so they are moved back under relatively light pressure or by a spring. Both principles are illustrated by the first and second handle assemblies 82 and 84 and the pressure control section 86 and the spring biasing assembly 88 although they can be applied to arm exercisers rather than hand exercisers as shown in FIG. 3.

The first handle assembly 82 includes a handle base 92, covered by a foam rubber cover 96 and extending downwardly between a base 90 and an end member 94 so that it may be gripped by one hand and pulled toward the second handle assembly 84.

The handle base 92 includes an enlarged portion 93, an inner support member 91 and an outer covering 96. The enlarged portion includes within it a pin hole 100, a spring hole 98 for the spring biasing assembly 88 and a left spring 192 adapted to be held in the spring hole 98 by a pin 196 that fits in the hole 100.

The enlarged portion 93 of the handle base 92 is at the top of the handle and beneath the base 90 to easily engage across flat sides with the second handle assembly 84 while pivoting about the base 90 so that the two handles of the first and second handle assemblies 82 and 84 are close together with the pressure adjustment assembly 86 extending therefrom.

The second handle assembly 84 similarly includes a base 110, an inner handle member 112, an end member 114, a foam rubber cover 116 for the inner handle member 112 and an enlarged offset section 113 of the handle member 112. The enlarged offset section 113 includes a spring hole 118 for the spring biasing assembly 88 and a spring retainer tapped hole 120.

The base 90 of the handle assembly 82 includes a central aperture 103, a counterbore 101 in the central aperture intersected by a hole adapted to receive a retaining pin 105. The aperture 103 and counterbore 101 are adapted to receive one end of the pressure control section 86 and that end is held in place by the retaining pin 109. The other side of the base 90 has an aperture 105 adapted to receive a molded pinion 107 that extends into the aperture 103 where the apertures 103 and 105 intersect.

The base 110 of the handle assembly 84 includes a central square apertures 140 extending through it and adapted to receive the other end of the pressure control section 86. It cooperates with the pressure adjustment assembly 86 to enable the two handle assemblies 82 and 84 to be pulled together and released. The pressure control section 86 includes a ratchet assembly 130, a first friction assembly 132, a second friction assembly 134, and a pressure adjustment assembly 136. The base 110 of the second handle assembly 84 includes annular flat bearing surfaces on each side. These two annular rings cooperate with the first and second friction units 132 and 134 to resist movement of the grips 92 and 95 toward each other.

The square central apertures in the four metal washers 162, 160, 170 and 172 engage four corresponding square detent members or bases to force them to move with respect to the washer on the opposite of its friction disks. The square detents are square boss 145, detects (not shown) corresponding to the square raised edges 141 on the opposite side of the aperture 140, the square edges 141 and corresponding edges (not shown) on the member 176, respectively.

To permit easy motion apart by a bias spring at the end of the movement of the first and second handle assemblies 82 and 84, the ratchet assembly 130 includes a ratchet wheel 142, an axle 144, and the molded pawl 107 within the opening 101. The axle 144 has a threaded portion 150 on one end and the other end has the ratchet wheel 142, the cylindrical boss 147 and square locking boss 145 thereon held by a set screw 152. Collar 148 fits over the cylindrical boss 147. Pawl 107 is permanently mounted within the hole 101 so that the axle 144 is rotatable freely in one direction inside the ratchet hole 103 but not in the other, thus permitting the friction disk 164 to move freely in one direction but not the other.

To provide an adjustable amount of friction resisting the movement of the two handles together while releasing it in the opposite direction, the first friction assembly 132 includes first and second metal washers 160 and 162 on either side of a leather friction disk 164. The metal washer 160, leather friction disk 164 and metal washer 162 are annular in shape. Metal washers 160 and 162 have central square apertures aligned with each other, the central cylindrical aperture of the leather friction disk 164 and with the central cylindrical aperture 140 on the second handle assembly 84.

The ratchet assembly 130 is positioned to pass through all of the apertures so that metal washer 162 lies against one side of the central friction disk 164 and the metal washer 160 lies against the other side of the central friction disk 164 of the first handle assembly 82 with the leather friction disk 164 between to provide an adjustable amount of friction against motion of the first and second handle assemblies 82 and 84 toward each other, with the ratchet wheel 142 locked depending on the force exerted normally to them. The square apertures in the friction disks 162 and 160 fit conformingly on the square.

On the opposite side of the second handle assembly 84, the second friction unit 134 has a similar arrangement fitting around the axle 144 and including a first metal washer 170, a second metal washer 172, and a leather friction disk 174 between them.

With this arrangement, the first and second friction units 132 and 134 are on opposite sides of the base 110 of the second handle assembly 84 and control the force necessary to move this second handle assembly 84 toward the first handle assembly 82, while it may be released from the ratchet wheel 142 to move easily in the opposite direction.

To adjust the pressure and thus the frictional force against which the first and second handle assemblies 82 and 84 are pulled together, the pressure adjusting member 136 includes an internal tapped hole 176 aligned to be threaded on the threaded portion 150 of the axle 144 and thus, control the pressure of the first and second friction units 132 and 134 against the friction surfaces of the second handle assembly 84 and the central friction disk 164. An aperture 180 is provided through which a shaft may be inserted to exert increased pressure. With this arrangement, the pressure may be easily adjusted and released by a user.

The spring biasing assembly 88 includes a shaft 190, a first spring 192, and a second spring 194. The first spring 192 fits within the spring hole 98 and within the end of the shaft 190 and the second spring 194 fits within the spring hole 118 on the other side of the shaft 190, with the shaft 190 being of such a size that it may move within the spring holes 98 and 118. Set screws 196 and 198 hold the first and second springs 192 and 194 within the spring holes 98 and 118 so that as the first and second handle assemblies 82 and 84 are pulled together, the first and second springs 192 and 194 are compressed, but without adding much force so that the overwhelming forces of bringing the first and second handle assemblies 82 and 84 together is frictional force.

On the other hand, when the first and second handle assemblies 82 and 84 are released, the first and second springs 192 and 194 have sufficient strength to permit the first and second handle assemblies 82 and 84 to be moved back because the axle 144 is free to rotate in that direction. Thus, the first and second springs 192 and 194 have sufficient strength to rotate the axle 144 but when the axle 144 is held in place by the ratchet wheel 142, the frictional force normally exerted is far greater than the force of the spring.

Figure 4:
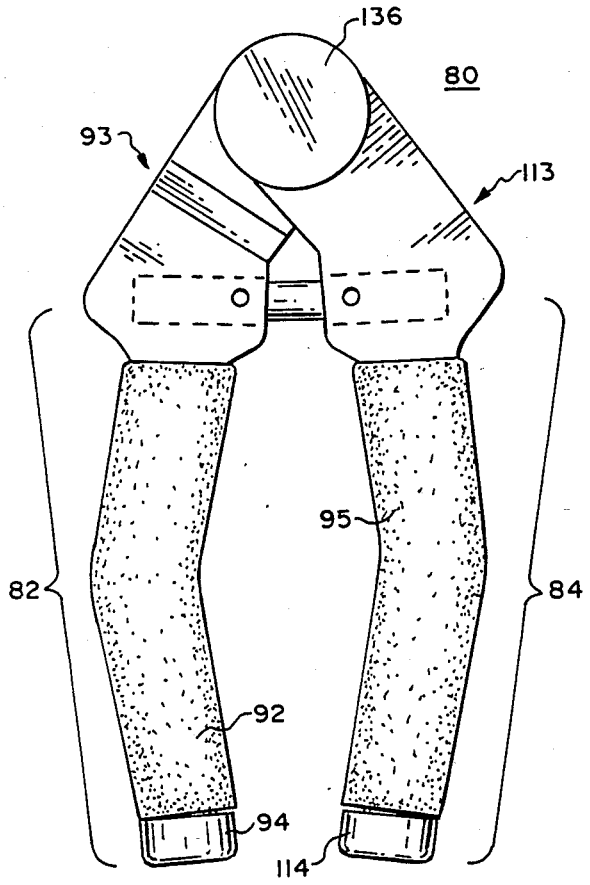
FIG. 4 is a rear elevational view of the hand grip exerciser of FIG. 3.

In FIG. 4, there is shown a rear elevational view of the first and second handle assemblies 82 and 84 of the hand exerciser 80 illustrating the manner in which the enlarged offset section 93 of the handle assembly 82 and the enlarged offset section 113 of the handle assembly 84 are mounted with the handle base 92 and inner handle member 112 (FIG. 2) parallel with each other in substantially the same plane. The base enlarged offset section 93 extends both behind and in front of the enlarged offset section 113 to support the pressure adjustment assembly 86 (FIG. 2) with the arms parallel.

In using the weighted jumping rope holder 10, two jump rope holders are adjusted as to weight. This is accomplished by unthreading the finger tightener bolt 70, after which the handle 12 and the washer 24 may be removed from the spindle 44 and the cylindrical weight 46 removed. A cylindrical weight 46 is selected having any of differing amounts of lead in its interior. Also separate weights may be selected either of nylon, steel or lead to reach the desired weight and then the handle 12 is replaced and the finger tightened bolt 70 threaded so that a complete unit is obtained with the desired weight.

Each of the two ends of the jumping rope 18 is inserted into a corresponding one of the rope sleeves 26 of the jump rope 18 by loosening the pressure adjustment means 28, inserting the end of the jumping rope 18 and tightening it. With the jumping rope 18 in position, the unit may then be used by gripping a different handle in each arm and going through the normal motions of jumping rope. When this is done, the rope sleeves 26 rotate to prevent twisting of the rope and the user of the equipment has the extra strain of the weight placed upon his arms for further exercise.

To use the hand exerciser 80, the pressure control section 86 is adjusted by rotating it to adjust the pressure between the central friction disk 164 and the end of the pressure adjusting member 136 by threading it onto the threaded portion 150 of the axle 144. When the pressure has been adjusted, the user grips the first and second handle assemblies 82 and 84 and pulls them together with one hand. During this motion, the set screw 152 is gripped by the pawl 107 and unable to move so that the motion of the first and second handle assemblies 82 and 84 is against the friction caused by the leather friction disks 164 and 174 against the first and second metal washers 170 and 172 of the first handle assembly 82 and the first and second metal washers 160 and 162 of the second handle assembly 84, respectively. When the user releases his grip, the first and second springs 192 and 194 move the first and second handle assemblies 82 and 84 back freely because the ratchet wheel 142 disengages the pawl 107 and offers no resistance.

From the above description, it can be understood that the weighted jump rope appliance of this invention has the advantages of combining in one compact package an ajustable weight and jump rope appliance to render the jump rope appliance easy to use and the weight adjustment convenient. The hand exerciser uses a readily adjustable force control which is easily adjusted for the amount of force in a hand grip or the like for movement in one direction with an easy release and return in the other direction.

Although a preferred embodiment of the invention has been described with some particularity, many modifications and variations in the preferred embodiment are possible within the light of the above teachings. Therefore, it is to be understood that, within the scope of the appended claims, the invention may be practiced other than as specifically described.

What is claimed is:

1. An exercise appliance comprising:

a body portion having a longitudinal axis, a first and a second end, and a hand grip formed on the outer surface of the body portion circumscribing the longitudinal axis;

a pivotable rope holder mounted to pivot with respect to said hand grip about said longitudinal axis;

said pivotable rope holder including sleeve means for holding the end of a rope in a direction perpendicular to the longitudinal axis of the body portion; pivot pin means for pivotably mounting said sleeve means to said body portion; and pressure adjustable means for clamping said end of said rope in place; said pressure adjustable means being pivotable with respect to both said body portion and said hand grip;

said sleeve means including a rope sleeve extending through the sleeve means in a direction orthogonal to the longitudinal axis of the body portion; and an internally threaded cylinder adapted to recieve the pressure adjustable means, whereby the pressure adjustable means may press against a rope to hold it within the sleeve; and a counterbore forming an annular surface for said pivot pin;

said pivot pin having a head sufficiently large to fit on said annular surface, whereby said sleeve means pivots about said pin; the pin having a portion threadable into said body portion; said body portion being hollow and adapted to receive at least one of a plurality of weights, whereby said exerciser may be adjusted in weight by selecting weights to be included in said body portion.

* * * * *